US005125829A

United States Patent [19]

McDonough et al.

[11] Patent Number: 5,125,829

[45] Date of Patent: * Jun. 30, 1992

[54] BIDIRECTIONAL SELECTIVELY ACTUATABLE LIGHTER

[75] Inventors: James M. McDonough, Guilford; Floyd B. Fairbanks, Naugatuck, both of Conn.

[73] Assignee: BIC Corporation, Milford, Conn.

[ * ] Notice: The portion of the term of this patent subsequent to Mar. 26, 2008 has been disclaimed.

[21] Appl. No.: 455,059

[22] Filed: Dec. 22, 1989

Related U.S. Application Data

[63] Continuation-in-part of Ser. No. 239,734, Sep. 2, 1988, Pat. No. 5,002,482.

[51] Int. Cl.[5] ..... F23D 11/36

[52] U.S. Cl. ..... 431/255; 431/277; 431/153; 222/153; 222/402.11

[58] Field of Search ..... 431/153, 254, 277, 255, 431/264; 222/153, 402.11, 509

[56] References Cited

U.S. PATENT DOCUMENTS

| | | | |
|---|---|---|---|
| 1,895,032 | 1/1933 | Fisher . | |
| 2,520,328 | 8/1950 | Nissen | 67/7.1 |
| 2,627,577 | 5/1953 | Wiessner | 292/122 |
| 2,727,376 | 12/1955 | Felt | 67/7.1 |
| 2,806,520 | 9/1957 | Adams | 158/73 |
| 3,169,672 | 2/1965 | Soffer et al. | 222/153 |
| 3,194,435 | 7/1965 | Burchett | 222/3 |
| 3,267,988 | 8/1966 | Schott | 158/73 |
| 3,450,143 | 6/1969 | Tamarin | 137/38 |
| 3,547,566 | 12/1970 | Tamarin | 431/88 |
| 3,601,165 | 8/1971 | Obata | 141/302 |
| 3,612,736 | 10/1971 | Steuernagel et al. | 431/130 |
| 3,723,048 | 3/1973 | Russell | 431/151 |
| 3,744,953 | 7/1973 | Herr | 431/13 |
| 3,752,637 | 8/1973 | Norman et al. | 431/274 |
| 3,756,766 | 9/1973 | Green | 431/254 |
| 3,816,056 | 6/1974 | Brown | 431/253 |
| 3,817,693 | 6/1974 | Sebens et al. | 431/153 |

(List continued on next page.)

FOREIGN PATENT DOCUMENTS

| | | |
|---|---|---|
| 296281 | 12/1988 | European Pat. Off. . |
| 2198092 | 3/1974 | France . |

(List continued on next page.)

OTHER PUBLICATIONS

EPC Search Report (no date given).
International Search Report (no date given).
Computer Search Results (no date given).

*Primary Examiner*—Carl D. Price
*Attorney, Agent, or Firm*—Pennie & Edmonds

[57] ABSTRACT

A selectively actuatable child resistant lighter device is disclosed which includes a body defining reservoir for containing a combustible gaseous medium such as butane, and having a valve arranged to be selectively actuated between a normally closed position and an open position which permits the exit of the gaseous medium. Such child resistant lighter can selectively produce sparks at a location proximate to the gaseous medium exit to ignite the gaseous medium. A safety mechanism normally prevents actuation of the valve to the open position. Such child resistant lighter device embodies a resiliently releasable safety latch which prevents the actuation of the valve actuator to the open position. The safety latch is selectively movable to a plurality of positions out of interference with the valve actuator, so that the gaseous medium may be released and ignited by the sparks. The safety latch is resiliently structured and mounted such that once a flame is produced and the valve actuator is released, the safety latch returns to its closed or locked position to prevent actuation of the valve to the open position by prevention of the pivotal motion of the valve actuator. To "re-use" the lighter, the safety latch must again be moved to one of the open or unlocked positions so that the valve actuator can be opened for subsequent ignition of the gaseous medium. Such mechanism is difficult for a young child to light, but is capable of actuation by adults.

49 Claims, 6 Drawing Sheets

U.S. PATENT DOCUMENTS

| | | | |
|---|---|---|---|
| 3,828,982 | 8/1974 | Steigerwald | 222/153 |
| 3,894,665 | 7/1975 | Swenson | 222/402.11 |
| 3,898,031 | 8/1975 | Rusakowicz | 431/130 |
| 3,899,286 | 8/1975 | Lockwood et al. | 431/321 |
| 3,910,752 | 10/1975 | Holl | 431/273 |
| 3,938,943 | 2/1976 | Malamoud | 431/150 |
| 3,940,023 | 2/1976 | Umstead | 222/153 |
| 3,955,585 | 5/1976 | Fox | 131/186 |
| 3,963,413 | 6/1976 | Lockwood et al. | 431/276 |
| 3,966,392 | 6/1976 | Lockwood | 431/344 |
| 3,985,493 | 10/1976 | Neyret | 431/150 |
| 4,003,694 | 1/1977 | Lowell | 431/344 |
| 4,008,992 | 2/1977 | Johnsson | 431/344 |
| 4,028,043 | 6/1977 | Neyret | 431/144 |
| 4,036,579 | 7/1977 | Marynissen | 431/131 |
| 4,049,370 | 9/1977 | Neyret | 431/144 |
| 4,102,633 | 7/1978 | Zellwegger et al. | 431/152 |
| 4,111,638 | 9/1978 | Ostberg | 431/13 |
| 4,150,940 | 4/1979 | Heller et al. | 431/130 |
| 4,181,490 | 1/1980 | Nitta | 431/129 |
| 4,190,412 | 2/1980 | Nitta | 431/151 |
| 4,324,351 | 4/1982 | Meshberg | 222/402 |
| 4,403,945 | 9/1983 | Leitgib | 431/150 |
| 4,413,638 | 11/1983 | Le | 131/174 |
| 4,416,612 | 11/1983 | Tabata | 431/131 |
| 4,432,542 | 2/1984 | Poynter | 272/27 |
| 4,457,699 | 7/1984 | Hattori | 431/344 |
| 4,487,570 | 12/1984 | Lowenthal | 431/130 |
| 4,522,583 | 6/1985 | Kraser | 431/128 |
| 4,717,335 | 1/1988 | Loveless | 431/277 |
| 4,758,152 | 7/1988 | Kordecki | 431/153 |
| 4,784,601 | 11/1988 | Nitta | 431/153 |
| 4,784,602 | 11/1988 | Nitta | 431/153 |
| 4,786,248 | 11/1988 | Nitta | 431/255 |
| 4,799,877 | 1/1989 | Bisbee | 431/153 |
| 4,810,187 | 3/1989 | Nitta | 431/255 |
| 4,822,276 | 4/1989 | Bisbee | 431/153 |
| 4,830,603 | 5/1989 | Cirami | 431/277 |
| 4,832,596 | 5/1989 | Morris, Sr. | 431/153 |
| 4,844,244 | 7/1989 | Mawby | 206/88 |
| 4,844,254 | 7/1989 | Jang | 206/236 |
| 4,846,667 | 7/1989 | Lin | 431/151 |
| 4,850,854 | 7/1989 | Buck | 431/143 |
| 4,854,859 | 8/1989 | Lin | 431/344 |
| 4,859,172 | 8/1989 | Nitta | 431/153 |
| 4,859,174 | 8/1989 | Zellweger et al. | 431/255 |
| 4,869,663 | 9/1989 | Fremund | 431/153 |
| 4,904,180 | 2/1990 | Nitta | 431/153 |
| 4,921,420 | 5/1990 | Johnston | 431/153 |

FOREIGN PATENT DOCUMENTS

| | | |
|---|---|---|
| 2220047 | 9/1974 | France . |
| 2633702 | 1/1990 | France . |

BIDIRECTIONAL SELECTIVELY ACTUATABLE LIGHTER

BACKGROUND OF THE INVENTION

1. Cross-Reference to Related Applications

This is a continuation-in-part of U.S. Pat. application Ser. No. 07/239,734 filed on Sep. 2, 1988, entitled "Selectively Actuatable Lighter", incorporated herein by reference.

2. Technical Field

This invention relates generally to lighters which consume fuel such as, for example, butane which is stored in a reservoir in a liquid state, then passed through an expansion valve means where it becomes gaseous, and finally ignited by a spark or other similar means. More particularly, the invention relates to a disposable butane cigarette lighter having a safety mechanism which prevents a valve actuator from being depressed and in turn prevents a valve, or fuel, nozzle from expelling butane thereby rendering operation of the lighter by young children difficult. Advantageously, the safety mechanism of the lighter may be deactivated by moving a safety latch to any one of a plurality of non-interfering positions, thus increasing the user friendliness of the lighter to the intended users.

2. Description of the Prior Art

Various prior art lighters, some of them incorporating safety features, are known. Safety features are generally provided to reduce the risk of injury to an operator or bystanders. Some of such safety features relate to mechanisms which prevent ignition of a fuel source unless the lighter is properly oriented, mechanisms which automatically turn off a fuel source supply valve and tamper protection arrangements.

More recently, attention has been directed toward preventing ready actuation of such lighters by persons normally not able to appreciate the potential danger of the flame. Such danger includes the potential to burn the individual directly or to burn surrounding areas or items, thus creating the possibility of spreading to a fully developed fire. Individuals normally contemplated in these efforts are small children, mostly in the age category of five years or younger.

For example, U.S. Pat. No. 4,830,603 to Cirami, not regarded as prior art, relates to a cigarette lighter in which a locking mechanism is provided partially under a valve-actuating pushbutton and extends into a compartment appended to but distinct from a fuel compartment. The locking mechanism relocks itself after each depression of the pushbutton. In particular, one end of a stiffly flexible, spring steel wire is held firmly in place in the compartment. Another end of the spring steel wire forms a probe extending into a channel provided in the underside of the pushbutton. The spring steel wire, in a locked configuration, prevents depression of the pushbutton by engaging a low ceiling on the underside of the pushbutton. A portion of the spring steel wire in the form of a loop extending outward from the lighter is accessible by an operator and may be suitably moved by the operator thereby causing the probe to move within the channel in the underside of the pushbutton.

U.S. Pat. No. 4,832,596 to Morris, Sr., not regarded as prior art, relates to a cigarette lighter having a stop member slidably mounted thereon for releasably engaging a gas valve actuating lever. In particular, a spring biased stop member is slidably mounted on a top portion of a conventional portable disposable cigarette lighter.

The stop member is biased so as to place one of its ends under the lighter's gas valve actuating lever so as to prevent movement of the lever in a direction which may open the gas valve. The lever may be actuated once the stop member is pushed in a direction opposite to the biasing force of the spring so as to slide the end which is under the lighter's gas valve outward.

U.S. Pat. No. 4,717,335 to Loveless relates to a cigarette lighter in which rotation of a spark-producing wheel is limited. In particular, the spark-producing wheel may be rotated in one direction to deliver a spark toward a nozzle through which gaseous fuel is passed, thereby operating the lighter and causing fuel to ignite. Rotation of the spark-producing wheel in the other direction may deliver a spark away from the nozzle. The spark-producing wheel has a pin-shaped structure attached thereto which serves to limit the rotation of the wheel to under 360° by contacting the housing structure. Thus, whether a spark indeed is produced depends upon the direction of attempted rotation and the position of the pin-shaped structure relative to the housing structure. In theory, once the lighter is operated and the fuel ignited, and the pin-shaped structure has traversed its entire path of travel, subsequent operation of the lighter is impeded since the pin-shaped structure comes into contact with the housing, preventing a spark from occurring in the vicinity of the fuel nozzle.

U.S. Pat. Nos. 4,028,043 and 4,049,370 each to Neyret relate to presale tamper protection mechanisms which partially surround a spark-producing wheel, fuel nozzle or depressable valve actuation member of a lighter. These presale tamper protection mechanisms are attached to the lighter housing by frangible webs and are removed by a purchaser after sale of the lighter to expose the spark-producing wheel, fuel nozzle and depressable valve actuation member. However, such a presale tamper protection mechanism is of limited value once initially removed by a purchaser.

U.S. Pat. Nos. 3,547,566 to Tamarin and 3,899,286 to Lockwood et al. relate to lighters having orientation sensing mechanisms which hinder or prevent actuation of the lighter in an inverted position. Unfortunately such mechanisms may not provide a sufficient degree of safety to young children who tamper with the lighter since they merely hinder operation in prescribed orientations.

Many safety mechanisms are unnecessarily complicated, present difficulty in their manufacture and exhibit a high likelihood of mechanical failure during use. Another disadvantage found in some devices is that the particular construction employed limits the shape and size of the lighter housing due to the requirement that the housing be large enough to accommodate the safety mechanism(s). Further disadvantages relate to the relative ease which some safety mechanisms may be defeated and to the reliability of the safety mechanisms. For example, some safety mechanisms may be overridden or removed with relative ease. Additionally, some devices are not equally adaptable for use with both right-handed and left-handed users, and some include inconveniently shaped levers or knobs which need to be actuated by the user in order to operate the lighter. Furthermore, some of these devices require repositioning of the lighter in an operator's hand after actuation of the safety mechanism and before the lighter is operated to produce a flame. For example, some lighters include a safety mechanism actuation means located sufficiently far from a valve actuation means, or on another side of the lighter than the valve actuation means, so as to result in awkward operation of the lighter. Additionally, the safety mechanism actuation means of some lighters is limited to a single position at which the lighter may be operated.

Although it is known to prevent or hinder presale actuation of a depressable valve actuation member or actuation of a lighter in a specified orientation, none of the above-described lighters provides an efficiently manufacturable, relatively small, reliable mechanism for preventing actuation of the depressable valve actuation member and movable into a plurality of non-interfering positions and which may easily be incorporated into the assembly of conventional lighters.

Although current efforts as described herein may sometimes be referred to as "child-proof lighters", "child-resistant lighters" or the like, it should be made clear that such developments are actually directed toward minimizing ready flame production on a flame producing lighter by persons normally considered incapable of appreciating the potential danger of a lighter flame.

Consistent with such efforts is the recognition that to develop a "child-proof" lighter per se, would not be viable. At best it can be reasonably sought to create a lighter which is "child-resistant", but how "child-resistant" a lighter will be will depend upon related factors and circumstances. For example, it is known that lighters are specifically designed to produce a flame. Accordingly, if the lighter were to come into the possession of a person incapable of appreciating the potential danger of the flame a potentially dangerous situation will prevail. This situation would be independent of the operating condition of the lighter and would prevail even if the lighter is in perfect working order. Further, in many instances lighters contain clear written warnings prominently displayed on their surface and, without proper supervision, a young child who gains possession of the lighter can cause harm by the fact that the warning will not be appreciated since it cannot be read and/or understood by the child. Accordingly, "child-resistant" efforts are best directed toward protecting the child from its own acts should the child come into possession of a lighter with or without the parents, knowledge or consent. The potential danger would prevail even if the lighter is a properly functioning lighter and has a clear warning displayed thereon advising the user to keep the lighter out of the reach of children.

Nevertheless, any such "child-resistant" lighter will have its limitations with respect to young children, and no such lighter should provide parents or adults with a false sense of security so that they may become less cautious in their handling of the lighter or permit ready access to the lighter by young children. Further, such lighters should not be made so difficult to light as to cause adults to use alternative forms of lighting, i.e., matches, which are generally considered to be potentially more dangerous. At best, the lighter should provide a young child with sufficient deterrent features as to prevent the child from readily producing a flame on the lighter or to deter the child from readily producing a flame at least for a time sufficient to permit the normally expected intervention of adult supervision.

The present invention is directed toward a flame producing lighter which is selectively actuatable in such a manner as to provide a substantial degree of difficulty for young children—mostly five years or younger—to actuate the lighter and produce a flame, while being user friendly and capable of actuation by right-handed as well as left-handed adults.

SUMMARY OF THE INVENTION

This invention relates to a child resistant selectively actuatable flame producing lighter having a safety mechanism which is normally in a locked position and is movable to any one of a plurality of unlocked or non-interfering positions in which the lighter may be operated. Advantageously, the safety mechanism may be operated with the same finger a user employs to depress a valve actuation lever, without requiring repositioning of the lighter in a user's hand. The plurality of unlocked positions enables the lighter to be adapted for use by right-handed as well as left-handed users with the same relative ease, without detracting from the effectiveness of the lighter's safety mechanism. Furthermore, the safety mechanism may be easily incorporated into the assembly process of conventional lighters.

In particular, the invention relates to a lighter which comprises a housing defining reservoir for containing a combustible gaseous medium under pressure, valve means arranged for selective actuation between a normally closed position which prevents exit of the gaseous medium from the reservoir, and an open position which permits exit of gaseous medium from the reservoir through the valve means, means for selectively producing sparks at a location proximate the gaseous medium exit opening of the valve means thereby selectively causing ignition of the gaseous medium, means normally positioned for preventing actuation of the valve means to the open position, the valve actuation prevention means being movable out of such position only by the application of an external force, means for receiving the valve actuation prevention means to facilitate actuation of the valve means and ignition of the gaseous medium, the receiving means including a plurality of non-interfering or unlocked positions whereby actuation of the valve means to the open position is permitted thereby selectively permitting exit of the combustible gaseous medium from the valve means and ignition of the gaseous medium by sparks produced by the spark-producing means, and means for selectivity moving the valve actuation prevention means to one of the plurality of non-interfering positions.

In a preferred embodiment the valve means is actuated to the open position by actuator means and the means for preventing actuation of the valve means to the open position comprises means for preventing pivotal movement of the actuator means by interference with the movement thereof. The valve actuation interference means is selectively movable to any one of the plurality of positions of the receiving means so as to be out of interference with the valve actuator means.

The valve actuation interference means is normally retained in a valve actuation interference position and the movement thereof to any one of the plurality of positions out of interference with the valve actuator means is resiliently provided. The resilient movement of the valve actuation interference means causes the valve actuation interference means to return to its position beneath the valve actuator once the valve actuator is released, thus preventing the valve means from opening. In particular, the receiving means comprises a plurality of guide notches, each located in the respective side of the valve actuator, and the valve actuation interference means is a safety latch movable laterally towards either one of two opposite sides of the valve actuator and upwards towards one of the guide notches until the valve actuator is depressed, whereby the gaseous medium exits and the safety latch moves down awaiting return to a locked position. Release of the valve actuator enables the safety latch to return to its locked position under the value actuator.

Preferably, the safety latch comprises a movable finger actuated portion adapted to be moved so as to place the lighter in an unlocked configuration, an interfering portion connected to the finger actuated portion for interfering with depression of the valve actuator, a central portion having an opening therein adapted for placement around a spring and serving to retain the safety latch in proximity with the valve actuator, and a pair of extension legs for facilitating deflection and stabilization of the safety latch within the lighter.

The means for selectively producing sparks preferably comprises flint material and a rotatable spark-producing wheel having a toothed surface positioned and arranged to selectively frictionally contact the flint material. Alternatively, the means for selectively producing sparks may comprise electric spark-producing means and more specifically, piezoelectric spark-producing means.

A fuel cutoff safety mechanism is disclosed for use in combination with a lighter comprising means for preventing actuation of a fuel supply under normal circumstances and means for selectively permitting actuation of the fuel supply, wherein such selective actuation of the fuel supply and a corresponding production of sparks by spark-producing means ignites fuel from the fuel supply. The actuation permitting means includes a depressable valve actuator which, upon depression, enables fuel to flow out from the fuel supply and a safety latch normally positioned so as to interfere with depression of the valve actuator and which normally prevents depression of the depressable valve actuator. This mechanism also includes means for receiving the safety latch in one of a plurality of non-interfering positions thereby permitting depression of the valve actuator. Application of a biasing force to the safety latch moves the safety latch out of the interference position and into one of the plurality of non-interfering positions so that selective actuation of the fuel supply and a corresponding production of sparks ignites the fuel. Preferably, there are two such non-interfering positions.

A portion of the safety latch is normally positioned between the valve actuator and a main body housing of the lighter and prevents depression of the valve actuator. Cross-wise, or lateral, movement of the safety latch in either of two directions provides a void between the valve actuator and the main body housing, the void being sufficient in size to enable the valve actuator to be depressed at least partially into the void. Upwards movement, at either side of the valve actuator, subsequent to the lateral movement, of the safety latch towards a non-interfering position of the latch receiving means located at least partially adjacent to either side of the valve actuator, the safety latch being resiliently maintained in the non-interfering position by pressure exerted by the safety latch on the valve actuator, enables the lighter to be placed in an unlocked configuration in which the valve actuator is capable of being depressed, thereby permitting fuel to flow.

A flame developing lighter is also disclosed which comprises a housing, fuel supply means for supplying fuel to be ignited, ignition means for igniting fuel, valve means for selectively permitting flow of the fuel, means for maintaining the lighter in a normally locked configuration in which fuel is prevented from flowing through the valve means, and means for selectively unlocking the lighter from the normally locked configuration. The selectively unlocking means is symmetrical and positionable into a plurality of unlocked or non-interfering positions. The selectively unlocking means is operable by a user's same finger as used to actuate the lighter without requiring repositioning of the lighter in the user's hand.

A valve actuator is included which normally prevents escape of the fuel supply when in a first position and is depressable to a second position which permits actuation of the fuel supply means thereby permitting fuel to flow out from the fuel supply means. Preferably, the maintaining means is a safety latch which normally prevents depression of the depressable valve actuator, wherein selective application of a biasing force by the operator to the safety latch permits depression of the valve actuator.

An improved flame producing lighter is also disclosed of the type having a housing, a fuel supply, a valve means for selectively supplying fuel from the fuel supply to a fuel nozzle and spark-producing means for producing sparks, wherein the improvement comprises means for selectively permitting actuation of the valve means thereby selectively permitting exit of fuel from the fuel supply through the valve means and ignition of the fuel by sparks produced by the spark-producing means.

The means for selectively permitting actuation comprises locking means. In particular, the locking means comprises pivotally mounted actuator means having an unlocked position and a locked position and means for preventing pivotal movement of the actuator means from the locked position to the unlocked position by interference with the movement thereof, wherein depression of the actuator means in the unlocked position provides fuel flow. The means for preventing pivotal movement preferably comprises a safety latch movable laterally to either side of the actuation means and then movable upwards towards either one of two guide notches in the actuator means.

The invention also relates to a flame developing lighter comprising a housing, fuel supply means for supplying fuel to be ignited, ignition means for igniting fuel, valve means for selectively permitting flow of the fuel and control means for preventing the combination of production of fuel flow and spark generation so as to prevent production of a flame and for permitting substantially simultaneous production of fuel flow and spark generation to produce a flame, the control means being bidirectionally actuatable.

The control means preferably comprises a valve actuator which normally prevents escape of the fuel from the fuel supply when in a first position and is depressable to a second position which permits actuation of the fuel supply means thereby permitting fuel to flow out from the fuel supply means. A safety latch is provided which normally prevents depression of the depressable valve actuator, wherein selective application of a biasing force by the operator to the safety latch permits depression of the valve actuator.

The invention also relates to a flame producing lighter resistant to unauthorized use and normally maintained in a locked configuration comprising a housing, fuel supply means for supplying fuel to be ignited, ignition means for igniting fuel, valve means for controlling the flow of the fuel, a valve actuator which normally prevents escape of the fuel when in a first position and is depressable to a second position which permits actuation of the fuel supply means thereby permitting fuel to flow out from the fuel supply means, a safety latch having an interfering portion normally positioned between the valve actuator and the housing which normally prevents depression of the depressable valve actuator and normally maintains the lighter in the locked configuration, latch receiving means located at least partially adjacent to the valve actuator and on each side thereof, wherein lateral movement of the safety latch in either direction provides a void between the valve actuator and the housing, the void being sufficient in size to enable the valve actuator to be depressed at least partially into the void, and further wherein upwards movement of the safety latch along either side of the valve actuator, subsequent to the lateral movement, into the latch receiving means enables the latch to be resiliently maintained by pressure exerted by the valve actuator on the safety latch so as to provide the lighter in the unlocked configuration in which the valve actuator is capable of being depressed, thereby permitting fuel to flow.

Advantageously, if the lighter is left unattended a young child or other such person will encounter difficulty in releasing any gaseous material to produce a flame due to the locking action of the safety latch and the effort required to move it laterally and upwards towards the unlocked position. Thus, in the event the lighter inadvertently comes into the possession of a young child, the child may be able to turn the spark-producing wheel but will, at best, only be able to produce sparks from the spark-producing wheel by rotating it against the flint. Gaseous material will not be released due to the action of the safety latch which directly prevents the valve actuator from being depressed thereby preventing the valve nozzle from expelling fuel.

Operation of the lighter requires a certain amount of dexterity and the application of concentrated forces as well as the application of a plurality of forces in multiple directions and in a specified sequence. Advantageously, these factors tend to render the lighter difficult to operate by young children.

Furthermore, the lighter of the present invention is a passive locking lighter. Advantageously, the lighter automatically returns to its locked configuration once the depressed valve actuator is released. Thus, the lighter is maintained in an at-rest or default configuration which is locked thereby preventing the production of a flame.

Advantageously, there exists a plurality of unlocked or non-interfering configurations of the lighter in which the lighter may be actuated. Accordingly, the lighter is adapted for use by right-handed as well as left-handed users with the same relative ease. Furthermore, the user may operate the safety mechanism with the same finger as used to depress the valve actuator without requiring the user to reposition the lighter in the user's hand.

BRIEF DESCRIPTION OF THE DRAWINGS

These and other objects, features, and advantages of the present invention will become more readily apparent from the following detailed description of the invention in which like elements are labelled similarly and in which.

DETAILED DESCRIPTION OF THE PREFERRED EMBODIMENTS

Figure 1:
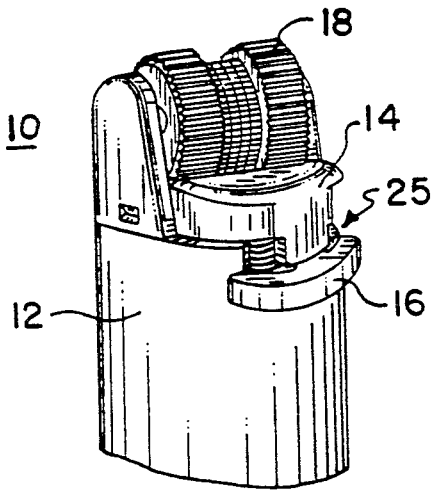
FIG. 1 is a perspective view of a preferred embodiment of a selectively actuatable child resistant lighter of the present invention in a locked configuration.
Figure 2:
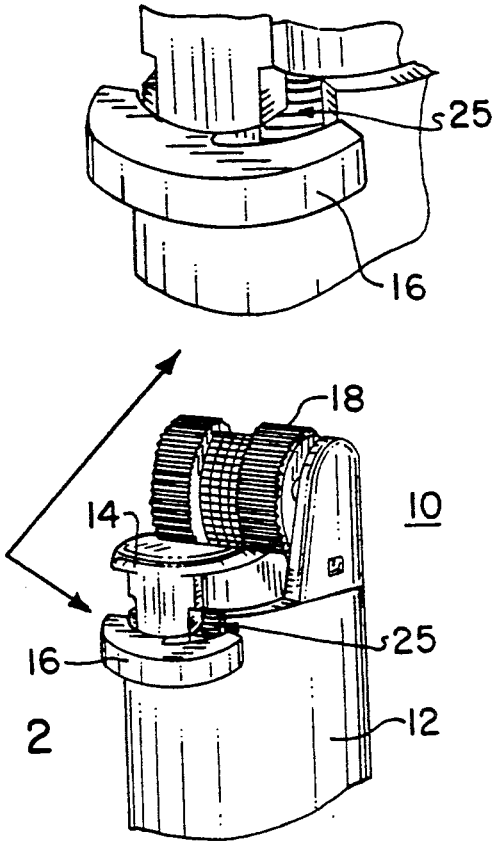
FIG. 2 is another perspective view from a different angle of the lighter depicted in FIG. 1 and further depicting a safety latch in greater detail.

Referring initially to FIGS. 1 and 2, there is depicted, in a default or at-rest configuration, the lighter of the present invention comprising a main body portion 12, a depressable valve actuator 14, a safety latch 16 and a spark-producing wheel 18. Advantageously, the default configuration is also a locked configuration in which valve actuator 14 cannot be depressed. Depression of valve actuator 14 permits fuel to flow through a fuel nozzle (not shown) and to be ignited by sparks produced by spark-producing wheel 18 frictionally engaging a flint (not shown). Advantageously, unless safety latch 16 is positioned away from its depicted at-rest or default position and into either one of two non-interfering positions defined by either one of two notches formed in valve actuator 14, any attempted depression of valve actuator 14 will not result in the flow of fuel and the lighter will be inoperable. The position of safety latch 16 as shown in FIGS. 1 and 2 may best be characterized as a "default position" under normal conditions.

A user typically holds the main body portion of the lighter in his hand, rotates with his thumb the spark-producing wheel in a direction toward the depressable surface of the valve actuator to produce a spark, while depressing the valve actuator to allow fuel to pass through the fuel, or valve, nozzle. The spark produced by the wheel ignites the fuel. This is a relatively conventional structure for most lighters, including disposable lighters.

Figure 3:
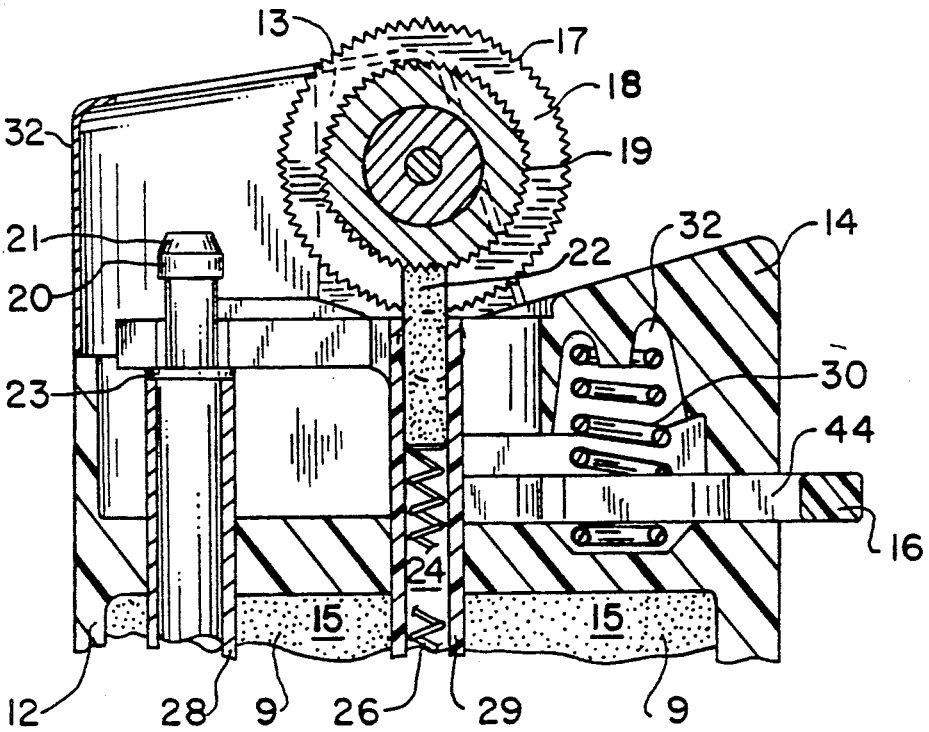
FIG. 3 is a partial cross-sectional view of the child resistant lighter of FIGS. 1 and 2 depicting the lighter in a locked configuration.

Referring now to FIG. 3, there is depicted a cross-section of the lighter of FIGS. 1 and 2 in a locked configuration. More particularly, valve actuator 14 is pivotally mounted between side wall portions 13 which comprise extensions of the side walls of body portion 12. Valve actuator 14 is attached to hollow fuel nozzle 20 slidably supported within a valve housing 28. Hollow fuel nozzle 20 is held within a bore in valve actuator 14 by flanges 21, 23 having sufficient diameter to prevent slippage of nozzle 20 through the bore in valve actuator 14. A compressed spring 30 resides partially within a recess 32 formed in valve actuator 14 and causes fuel nozzle 20 to be urged downward into valve housing 28 and body portion 12. In particular, compressed spring 30 causes valve actuator 14 to apply force to flange 23 thereby urging nozzle 20 downward into valve housing 28 and body portion 12 and preventing the flow of fuel through nozzle 20. In such an embodiment, valve actuator 14 is employed to lift nozzle 20 by the application of force to flange 21 in order to expel fuel. Alternatively, actuation of valve actuator 14 may serve to remove pressure maintaining the valve nozzle in a closed position. A conventional valve assembly (not shown) is located near the recessed end of nozzle 20 and permits fuel to flow through nozzle 20 only when valve actuator 14 is depressed and nozzle 20 lifted.

Lighter 10 further comprises a sparking flint 22 mounted within a bore 24 defined by flint and spring housing 29 in main body 12. Flint 22 is urged toward spark-producing wheel 18 by spring 26. Sparking wheel 18, which includes a toothed surface 19 which is preferably suitably hardened and against which flint 22 is urged, is mounted for rotation between side wall extension portions 13 in a conventional manner. Toothed surface 19 includes suitable indentations which define teeth such that when sparking wheel 18 is rotated toothed surface 19 cuts against flint 22 causing the generation of ignition sparks. Additionally, sparking wheel 18 includes suitable indentations 17 which facilitate rotation of sparking wheel 18 by an operator's finger.

Main body 12 defines an internal chamber 15 which is filled with a fuel 9 such as butane fuel capable of vaporizing in a conventional manner to produce a gaseous medium which passes through fuel nozzle 20 under the control of a valve. Main body 12 is constructed from any suitable structural material and is preferably constructed from a plastic material. Polyacetal is a preferred material for main body 12. However, alternative materials such as styrene acrylonitrile, polyester, nylon or the like may be used. A shield 32, preferably constructed from metal, is provided and functions as a wind guard around the flame thereby assisting in the ignition of the fuel.

As depicted in FIGS. 1 and 2 a notched opening 25 is provided in body portion 12 to accommodate valve actuator 14 and safety latch 16 and, in particular, lateral and upwards movement of safety latch 16. As will be appreciated, FIGS. 1–3 depict the lighter of the present invention in a locked configuration, i.e., a default configuration. In this locked configuration, safety latch 16 is positioned directly beneath valve actuator 14 and prevents depression of valve actuator 14, thereby preventing operation of the lighter.

Advantageously, notched opening 25 is shaped and symmetrically formed in body portion 12 such that safety latch 16 may be positioned to either side of valve actuator 14, as will be discussed in conjunction with FIGS. 9–12 and 15–26. Accordingly, right-handed as well as left-handed intended users will feel equally comfortable in actuating the lighter without detracting from the effectiveness of the lighter's safety mechanism.

Figure 4:
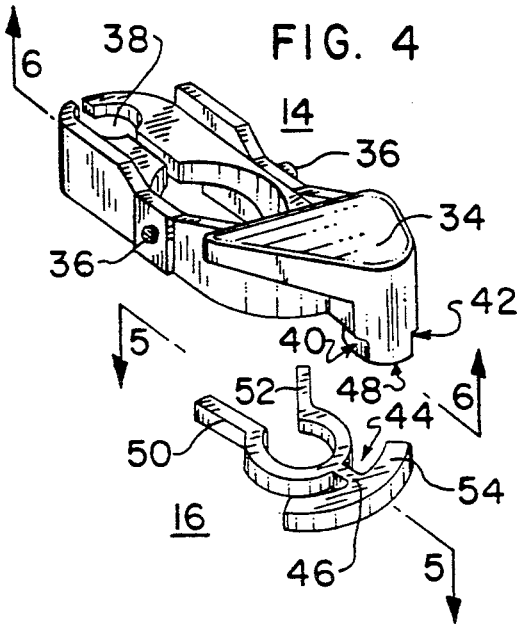
FIG. 4 is an exploded view of a valve actuator and safety latch depicted in FIGS. 1-3.

Referring now to FIG. 4, there is depicted valve actuator 14 and safety latch 16 in greater detail. Valve actuator 14 comprises a finger depressable surface 34, extensions 36, a bore 38, a first stepped, or guide, notch 40 and a second stepped, or guide, notch 42. Preferably, first and second stepped notches 40, 42, respectively, are similarly shaped. A user desiring to actuate the lighter depresses finger depressable surface 34. Extensions 36 are provided to matingly engage with bores in side wall portions 13 of body portion 12 to provide pivotal movement of the valve actuator about extensions 36. Bore 38 is adapted for receiving and grasping a portion of fuel nozzle 20 between flanges 21 and 23. As will be appreciated, stepped notches 40 and 42 are provided for engagement with an interfering portion 44 of safety latch 16 during actuation of the lighter. In the locked or closed configuration depicted in FIGS. 1-3, an upper surface 46 of interfering portion 44 of safety latch 16 is flush against a lower surface 48 of valve actuator 14, and a lower surface of interfering portion 44 of safety latch 16 is flush against a section of body 12 formed by notch 25, thereby preventing depression of valve actuator 14.

Safety latch 16 is provided with pivoting extensions, or legs, 50, 52 which facilitate deflection and stabilization of safety latch 16 within body portion 12 and assure proper positioning and retention of safety latch 16 in notched opening 25 especially when the safety latch is moved. Each of extensions 50, 52 is dimensioned and structured to respectively engage an inner wall or a structural member of the lighter housing when safety latch 16 is moved in a lateral direction. Safety latch 16 is also provided with a curved finger actuated portion 54 which is movable in a lateral direction toward either side of valve actuator 14. In particular, lateral movement of finger actuated portion 54 followed by upward movement thereof causes interfering portion 44 to engage either stepped notch 40 or stepped notch 42. Preferably, the width of interfering portion 44 and the width of notch 25 are chosen such that once one side of interfering portion 44 engages either stepped notch 40 or stepped notch 42, an opposite side of interfering portion 44 will abut or nearly abut a section of body portion 12 formed by notch 25. Notch 25 is illustratively rectangular in shape. Advantageously, such a configuration, in conjunction with forces provided by pivoting extensions 50 and 52, facilitates resilient movement of interfering portion 44 and finger actuated portion 54 with respect to safety latch 14 and the sections of body portion 12 defining notch 25. Additionally, such a configuration, in conjunction with forces provided by pivoting extensions 50 and 52, facilitates retention of the lighter and, in particular, the safety latch, in an unlocked position once the safety latch is placed in such an unlocked position and until valve actuator 14 is depressed. Although safety latch 16 is depicted as having a relatively smooth surface on finger actuated portion 54, portion 54 or parts thereof may be provided with a ridged surface. Such a ridged surface provides frictional resistance with a user's finger to facilitate movement of finger actuated portion 54 with respect to valve actuator 14.

Figure 5:
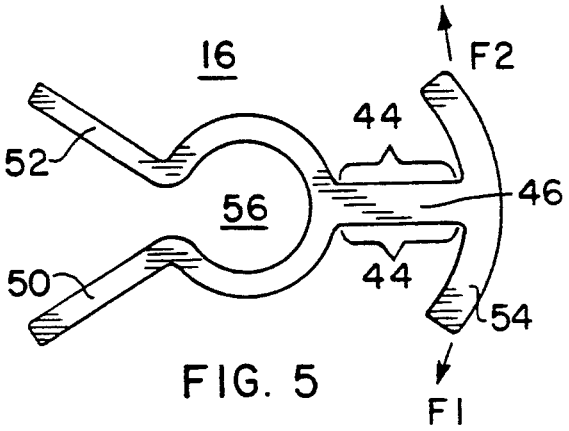
FIG. 5 is a top view along line 5—5 of the safety latch depicted in FIG. 4.

Referring to FIG. 5, there is illustrated a view of the topside of safety latch 16 taken along line 5—5 in FIG. 4. Safety latch 16 is preferably symmetrical. Finger actuated portion 54 of safety latch 16 is flexible in a first direction F1 towards one side of valve actuator 14 as well as in an opposite direction F2 towards another side of valve actuator 14. Opening 56 accommodates spring 30 (FIG. 3) and is of sufficient size to enable movement of safety latch 16 into locked and unlocked positions and not to impair movement of spring 30.

Advantageously, symmetrical safety latch 16 can be easily incorporated into the assembly process of conventional lighters. It is desirable that the material from which latch 16 is constructed is relatively rigid material which is sufficiently resilient to permit movement of finger actuated portion 54 towards a section of body 12 defining notch 25 so as to at least partially close the opening thereinbetween. Safety latch 16 is preferably constructed of polyetherimide. Illustrative of alternative materials from which safety latch 16 may be constructed include polysulfone, polyethersulfone, or any sufficiently resilient metal or elastomer, as well as a wide variety of other suitable materials.

Figure 6:
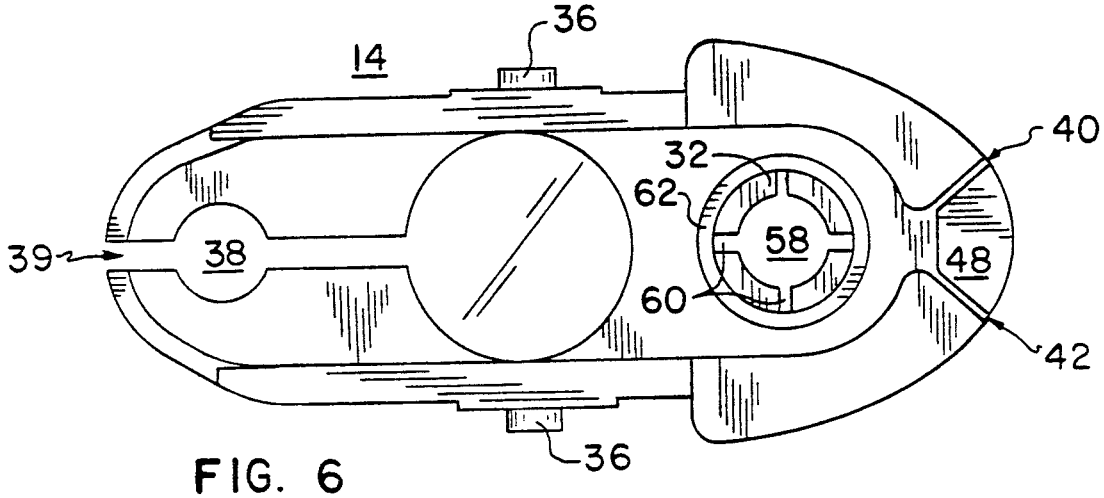
FIG. 6 is a bottom view along line 6—6 of the valve actuator depicted in FIG. 4.

Referring now to FIG. 6, there is depicted a view of the underside of valve actuator 14 along line 6—6 in FIG. 4. Recess 32 is adapted to receive spring 30 as depicted in FIG. 3 and may take on a variety of forms such as a simple indentation or, alternatively, a bore partially into valve actuator 14 and having a center pin 58, extensions 60 and a chamfered edge 62. Insertion of the fuel nozzle into bore 38 of valve actuator 14 during assembly of the lighter is facilitated by slot 39 which permits expansion of bore 38 to receive the fuel nozzle. Valve actuator 14 is constructed from material having sufficient dimensional stability and rigidity to continuously over the life of the lighter assure proper relative positioning between lower surface 48 of valve actuator 14 and upper surface 46 of interfering portion 44 of safety latch 16. Actuator 14 is preferably constructed from glass filled polyetherimide. Other illustrative materials from which valve actuator 14 may be constructed are zinc, brass, aluminum and other glass filled polymers such as polysulfone, polyethersulfone or the like.

Figure 7:
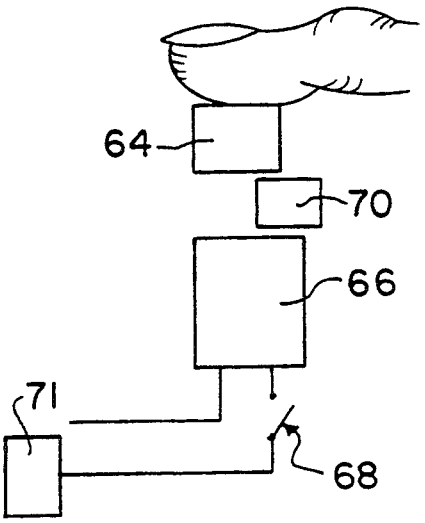
FIG. 7 is a schematic diagram depicting a piezoelectric lighter apparatus in which the present invention may be employed and having an optional safety switch depicted in the open position and a locking means depicted in the locked position to prevent the production of sparks and the flow of fuel.

FIG. 7 schematically depicts a piezoelectric type lighter in which the present invention may be employed. The piezoelectric lighter comprises hammer and fuel release means 64, spark providing means 66, electrical cut-off safety switch 68, locking means 70 and valve means 71. The piezoelectric lighter operates in a conventional manner except for depression of hammer means 64 which is prevented by inclusion of locking means 70 operative on the fuel supply in accordance with the present invention. Illustratively, such a locking means comprises a safety latch and a valve actuator which preferably prevent the flow of fuel as previously described, as well as preventing the production of sparks. In particular, locking means 70 may prevent the production of sparks by electrically isolating an energy source from the spark producing means. Alternatively, the locking means may be arranged to selectively prevent only the flow of fuel or it may be arranged to selectively prevent the production of sparks. As depicted in FIG. 7, the lighter is in a locked configuration since locking means 70 is positioned so as to prevent actuation of hammer means 64. Additionally, safety switch 68 is depicted in an open, or off, position.

Figure 8:
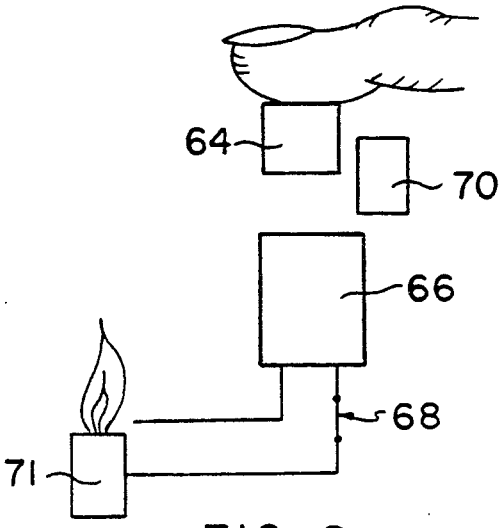
FIG. 8 is a schematic diagram depicting the piezoelectric lighter of FIG. 7 with the safety switch depicted in the closed position and the locking means depicted in the unlocked position and depicting a flame.

FIG. 8 schematically depicts the piezoelectric type lighter of FIG. 7 in an unlocked configuration. In particular, locking means 70 is positioned so as to enable actuation of hammer means 64. Additionally, safety switch 68 is depicted in a closed, or on, position.

Figure 9:
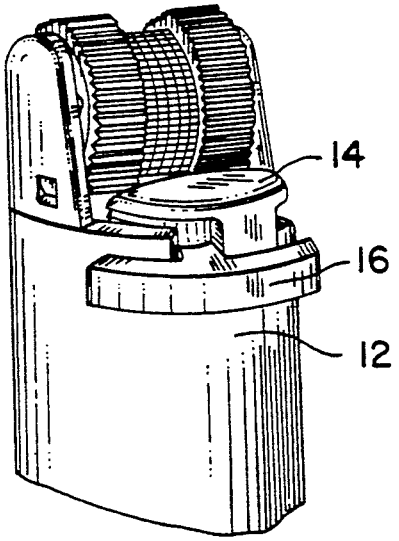
FIG. 9 is a perspective view of a preferred embodiment of the child resistant lighter in an unlocked configuration in which the position of the safety latch is moved from its at-rest locked position to a first side of the valve actuator thereby allowing for the valve actuator to be depressed so as to allow a valve to be opened and to release gas through a fuel nozzle.
Figure 10:
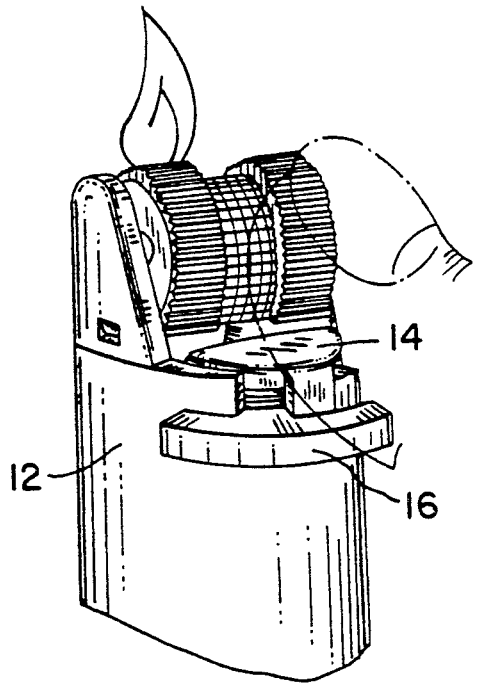
FIG. 10 is a perspective view of the child resistent lighter of FIG. 9 with the valve actuator in a depressed position.

In operation of the present invention, and as depicted in FIGS. 9 and 10, a user must first move safety latch 16 in a lateral, or cross-wise, direction so as to sufficiently displace interfering portion 44 of safety latch 16 towards a section of main body 12 defining notch 25 to ultimately permit depression of valve actuator 14. However, in order to facilitate retention of safety latch 16 in such a displaced position, safety latch 16 is then displaced in an upwards direction such that interfering portion 44 of safety latch 16 abuts notch 40 of valve actuator 14 (see FIG. 4). Such an unlocked configuration is depicted in FIG. 9. Depression of valve actuator 14 at this point combined with and preferably preceded by rotation of spark-producing wheel 18 will cause the lighter to operate, as indicated in FIG. 10. In particular, the sparks thus produced will ignite the gaseous fuel which is permitted to be expelled from nozzle 20 when valve actuator 14 lifts nozzle 20 thereby actuating the valve. The lifting action of valve actuator 14 in a vicinity near nozzle 20 partially relieves the pressurized condition in the fuel chamber thereby permitting the flow of fuel as a gaseous medium through nozzle 20 and the subsequent burning of such fuel.

Figure 11:
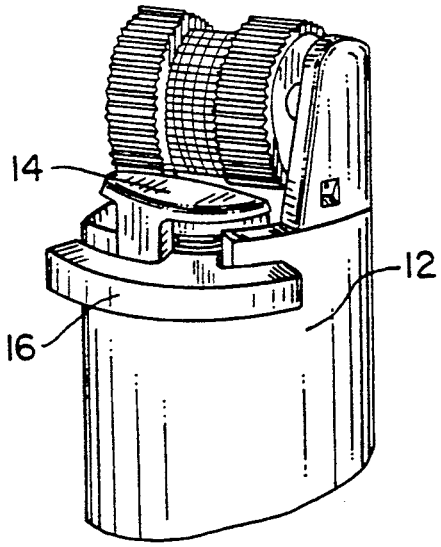
FIG. 11 is a perspective view of a preferred embodiment of the child resistant lighter in an unlocked configuration in which the position of the safety latch is moved from its at-rest locked position to a second side of the valve actuator and the valve actuator may be depressed so as to allow a valve to be opened and to release gas through a valve nozzle.
Figure 12:
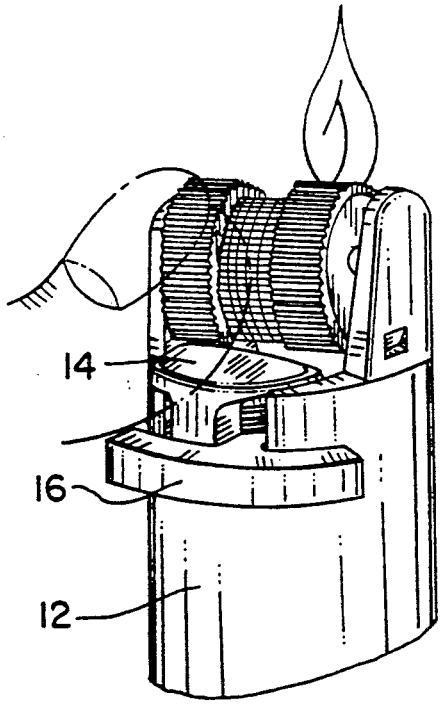
FIG. 12 is a perspective view of the child resistent lighter of FIG. 11 with the valve actuator in a depressed position.

Thus, the presently preferred embodiment of the invention may be placed in an unlocked configuration from its default locked configuration by moving interfering portion 44 of the safety latch into engagement with a first stepped notch 40 (not shown in FIGS. 9–10) at a first side of valve actuator 14 as depicted in FIGS. 9–10. However, this same embodiment may also be unlocked by moving interfering portion 44 of the safety latch into engagement with a second stepped notch 42 (not shown in FIGS. 11–12) at a second side of valve actuator 14 as depicted in FIGS. 11–12. Accordingly, the lighter of the present invention may be used by right-handed as well as left-handed intended users with the same relative ease. Additionally, it is possible that not all right-handed or left-handed users feel most comfortable moving the finger actuated portion of the safety latch in the same direction. Advantageously, the lighter of the present invention enables every user, whether right-handed or left-handed, to actuate the lighter by urging the finger actuated portion in different directions.

Figure 13:
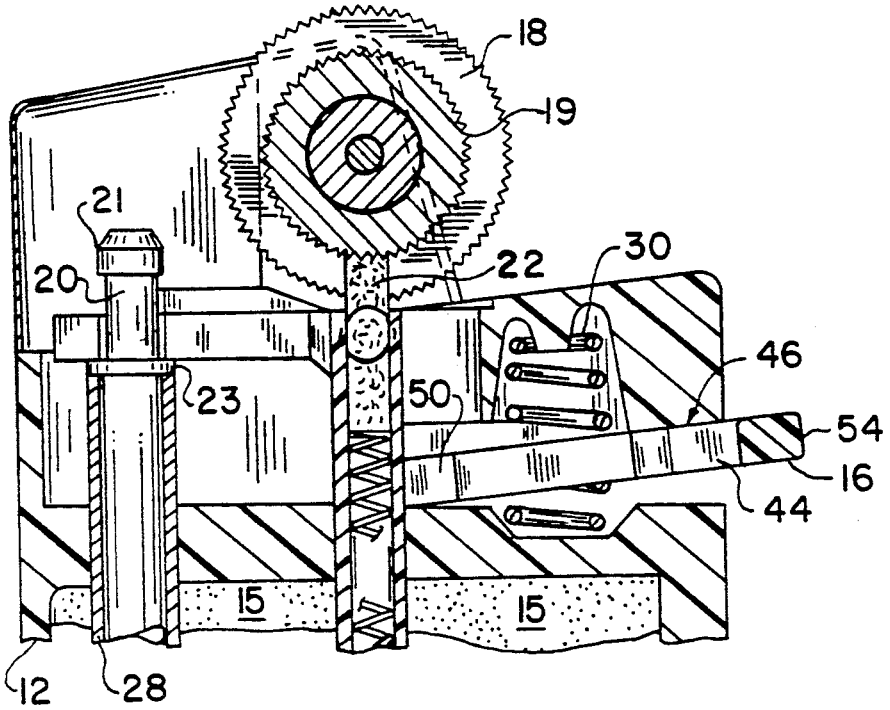
FIG. 13 is a partial cross-sectional view of a preferred embodiment of the child resistant lighter depicting the lighter in an unlocked but not depressed configuration.

Referring to FIG. 13, there is depicted a partial cross-sectional view of the lighter of the present invention in an unlocked and undepressed, i.e., not actuated, configuration. As can be seen from FIG. 13 in conjunction with FIG. 4, interfering portion 44 has been moved so as to engage notch 40 of valve actuator 14. Advantageously, forces provided by pivoting extensions 50 and 52 which urge portion 44 into notch 40 facilitate retention of the lighter and, in particular, safety latch 16, in an unlocked and undepressed position as depicted in FIG. 13. Alternatively, the lighter may be configured so as to be unlocked and undepressed by positioning finger actuated portion 54 so as to place interfering portion 44 into engagement with notch 42 (FIG. 4). In other words, the lighter may be readied for actuation and flame production by either moving finger actuated portion 54 in a first lateral direction and then upwards so as to place interfering portion 44 into engagement with notch 40 on one side of valve actuator 14 or, alternatively, by moving finger actuated portion 54 in a second lateral direction, opposite the first lateral direction, and then upwards so as to place interfering portion 44 into engagement with notch 42 on an opposite side of valve actuator 14.

Figure 14:
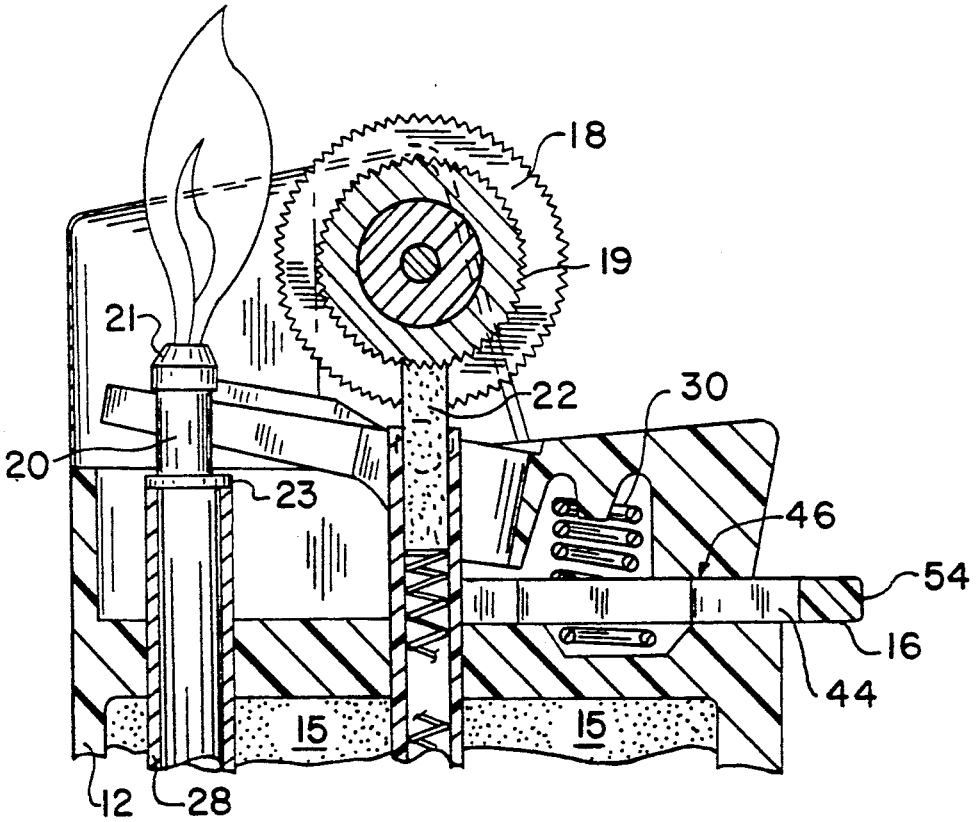
FIG. 14 is a partial cross-sectional view of a preferred embodiment of the child resistant lighter depicting the lighter in an unlocked and depressed configuration.

Referring now to FIG. 14, there is depicted a cross-section of the lighter of the present invention in a depressed and actuated configuration. As will be appreciated, movement of finger actuated portion 54 of safety latch 16 and, in particular, interfering portion 44 into engagement with either one of notches 40, 42 will permit unimpeded depression of the valve actuator as depicted in FIG. 14.

More specifically, such movement of safety latch 16 followed by depression of valve actuator 14 will cause compression of spring 30 and urging of fuel nozzle 20 upward and partially out of valve housing 28 and body portion 12. Such lifting of fuel nozzle 20 upward will permit fuel to flow from chamber 15 through the valve (not shown) and out of nozzle 20 whereupon it will have been ignited by sparks produced by flint 22 and toothed surface 19 of spark-producing wheel 18. Hollow fuel nozzle 20 is held within bore 38 (FIG. 4) in valve actuator 14 by flanges 21, 23 having sufficient diameter to assure proper movement of the nozzle within valve housing 28.

Figure 15:
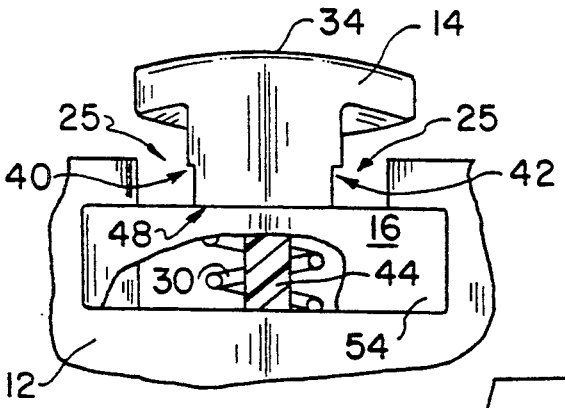
FIG. 15 is a frontal view of the safety latch of the preferred embodiment of the child resistent lighter in its locked position thereby preventing depression and actuation of the valve actuator.

FIGS. 15–20 depict the sequence of operations required for the unlocking and locking of the lighter by positioning interfering portion 44 on one side of valve actuator 14. In particular, FIG. 15 depicts safety latch 16 and valve actuator 14 in the default or locked position. In this position, depression of valve actuator 14 by finger pressure on surface 34 is prevented by the contact between lower surface 48 of valve actuator 14 and upper surface 46 (FIG. 4) of interfering portion 44 of the safety latch. As depicted in FIG. 15, interfering portion 44 is positioned directly beneath lower surface 48 of valve actuator 14 and safety latch 16 is prevented from any further downward movement since a lower surface of interfering portion 44 abuts a wall of body 12 defining notch 25.

Figure 16:
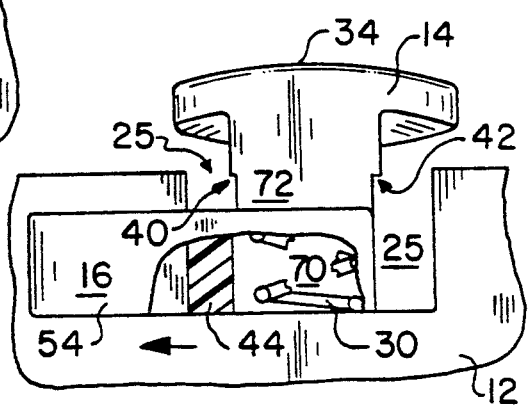
FIG. 16 is a frontal view of the safety latch in a partially unlocked position at a first side of the valve actuator.

FIG. 16 depicts safety latch 16 in a partially unlocked position and valve actuator 14 in an undepressed position. Finger actuated portion 54 and interfering portion 44 of safety latch 16 have been moved in a direction indicated by the arrow, providing a void 70 into which a portion 72 of valve actuator 14 may be subsequently inserted. As depicted, portion 44 of safety latch 16 is under compressive loading. Absent any holding pressure on finger actuated portion 54 in the position depicted in FIG. 16, interfering portion 44 and finger actuated portion 54 will return to their at-rest position as depicted in FIG. 15.

Figure 17:
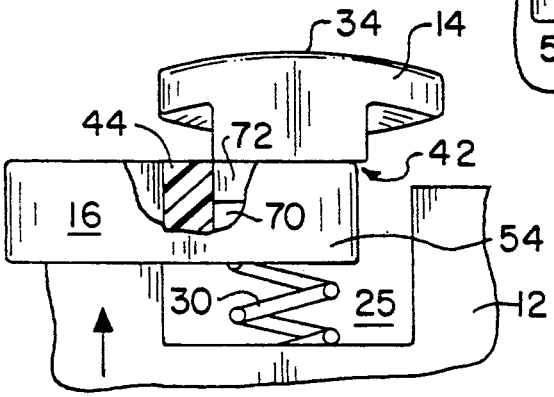
FIG. 17 is a frontal view of the safety latch in its fully unlocked position at a first side of the valve actuator.

FIG. 17 depicts safety latch 16 and valve actuator 14 in an unlocked configuration ready for depression of valve actuator 14. Interfering portion 44 of safety latch 16 has been moved upwards in a direction indicated by the arrow towards stepped, or guide, notch 40 (FIG. 4) of valve actuator 14. Advantageously, due to the compressive loading which safety latch 16 is under when portion 44 engages notch 40, removal of holding pressure from finger actuated portion 54 once interfering portion 44 has been engaged with or inserted towards notch 40 will not result in interfering portion 44 or finger actuated portion 54 slipping toward void 70 but will maintain the lighter in the configuration depicted in FIG. 18, until valve actuator 14 is depressed.

Figure 18:
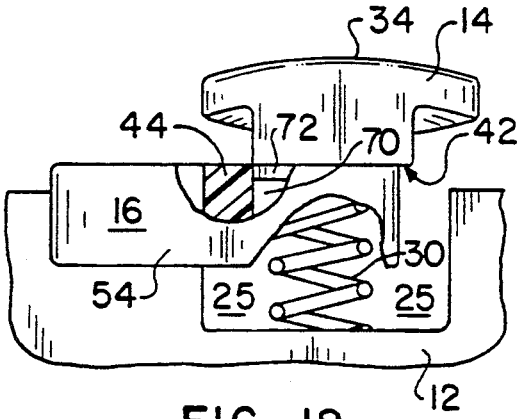
FIG. 18 is a frontal view of the safety latch in its unlocked position at a first side of the valve actuator and ready for actuation.
Figure 19:
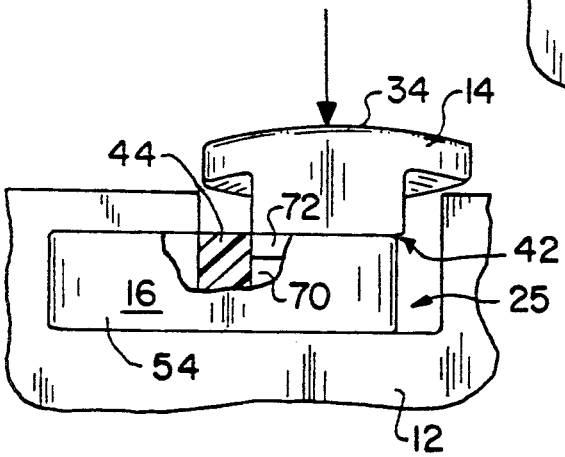
FIG. 19 is a frontal view of the safety latch in its unlocked position at a first side of the valve actuator and the valve actuator depressed so as to permit the flow of fuel.

Application of finger pressure to finger depressable surface 34 of valve actuator 14 as depicted in FIG. 18 will yield the configuration depicted in FIG. 19 in which valve actuator 14 has been depressed thereby permitting fuel to flow through the valve and the fuel nozzle (not shown). In particular, as valve actuator 14 is depressed, notch 40 of the valve actuator facilitates the urging of safety latch 16 downward toward its locked position. Provided that spark-producing wheel 18 (FIG. 7) was actuated in combination with valve actuator 14 being depressed, the fuel flowing through the fuel nozzle will be ignited. Such fuel will continue to flow and burn as long as sufficient pressure is maintained on valve actuator 14.

Figure 20:
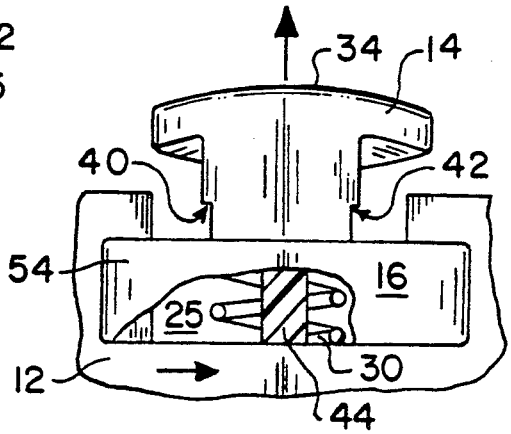
FIG. 20 is a frontal view of the safety latch in its locked position after the valve actuator was depressed and released.
Figure 21:
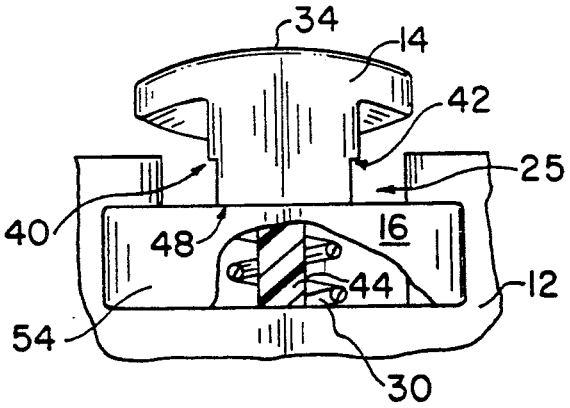
FIG. 21 is a frontal view of the safety latch of the preferred embodiment of the child resistent lighter in its locked position thereby preventing depression and actuation of the valve actuator.
Figure 22:
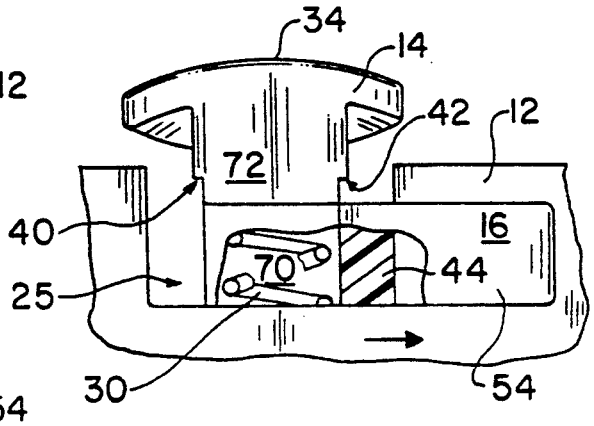
FIG. 22 is a frontal view of the safety latch in a partially unlocked position at a second side of the valve actuator.
Figure 23:
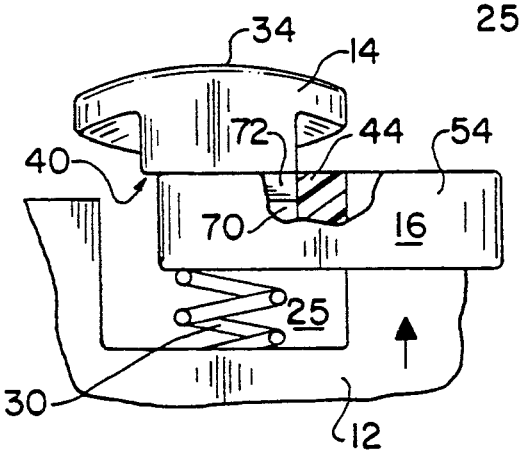
FIG. 23 is a frontal view of the safety latch in its fully unlocked position at a second side of the valve actuator.
Figure 24:
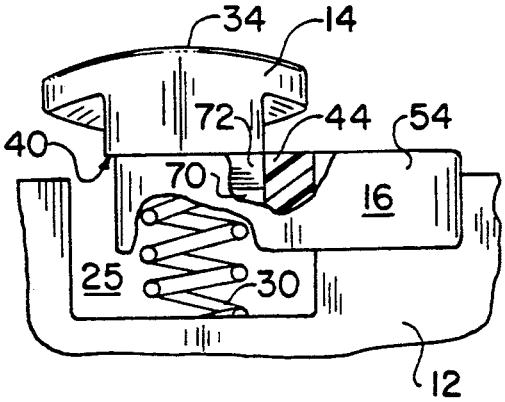
FIG. 24 is a frontal view of the safety latch in its unlocked position at a second side of the valve actuator and ready for actuation.
Figure 25:
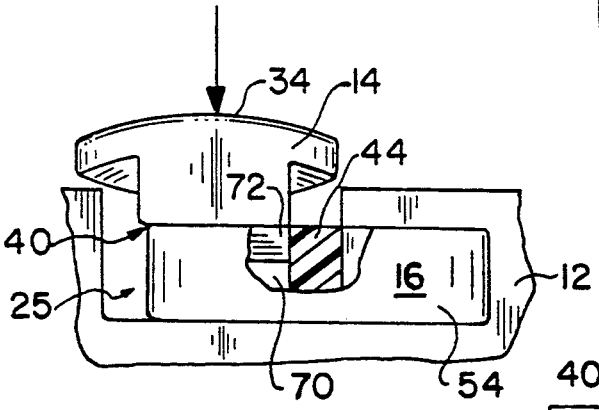
FIG. 25 is a frontal view of the safety latch in its unlocked position at a second side of the valve actuator and the valve actuator depressed so as to permit the flow of fuel.
Figure 26:
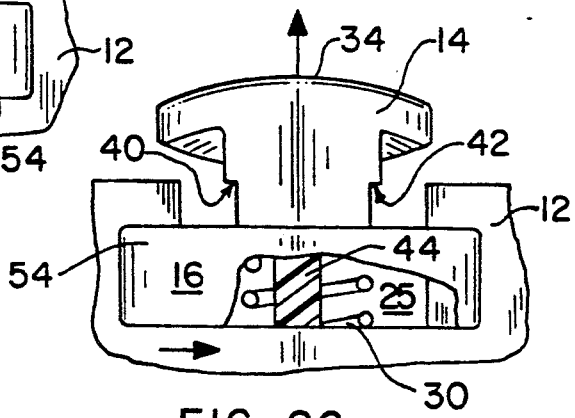
FIG. 26 is a frontal view of the safety latch in its locked position after the valve actuator was depressed and released.

Once pressure is removed from valve actuator 14, the valve actuator will move upward due to the biasing force provided by spring 30 as indicated in FIG. 20, and the flame will be extinguished. Advantageously, as valve actuator 14 moves upward, safety latch 16 remains in the down position since frictional forces between interfering portion 44 and actuator 14 are less than the forces required to lift the safety latch and overcome, inter alia, such forces as those required to deflect extensions 50, 52. Once valve actuator 14 moves upward a sufficient amount, interfering portion 44 moves in the direction indicated by the arrow in FIG. 20 towards its at-rest position.

FIGS. 21-26 depict the sequence of operations required for the locking and unlocking of the lighter by positioning interfering portion 44 on a second side of valve actuator 14. This second side is opposite the first side of actuator 14 against which interfering portion 44 was urged during the sequence depicted in FIGS. 15-20. The sequence of operations depicted in FIGS. 21-26 are identical to those of FIGS. 15-20, except that finger actuated portion 54 of safety latch 16 is moved in a lateral direction opposite from that depicted in FIGS. 15-20. Accordingly, interfering portion 44 engages notch 42 to place the lighter depicted in FIGS. 21-26 in an unlocked configuration.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

More specifically, the locking mechanism and lighter disclosed and claimed herein are not limited to use in disposable lighters. Additionally, a flame height adjusting mechanism may be provided to selectively adjust the height of the flame. Moreover, the present invention is in no way limited to a locking mechanism in which a safety latch is moved first in a lateral direction then in an upwards direction ninety degrees from the lateral direction in order to provide a void into which a valve actuator may be depressed. For example, any of a wide variety of locking mechanisms or actions may be employed, such as mechanisms having right-left, front-rear, over and down, in and over, etc. type actions.

What is claimed is:

1. A flame producing lighter which comprises:

a housing defining reservoir for containing a combustible gaseous medium under pressure;

valve means arranged for selective actuation between a normally closed position which prevents exit of said gaseous medium from said reservoir, and an open position which permits exit of gaseous medium from said reservoir through said valve means;

means for selectively producing sparks at a location proximate the gaseous medium exit opening of said valve means thereby selectively causing ignition of said gaseous medium;

means normally positioned for preventing actuation of said valve means to the open position, said valve actuation prevention means being movable out of said position only by application of an external force; and means for receiving said valve actuation prevention means to facilitate actuation of said valve means and ignition of said gaseous medium, said receiving means including a plurality of non-interfering positions whereby actuation of said valve means to the open position is permitted thereby selectively permitting exit of said combustible gaseous medium from said valve means and ignition of said gaseous medium by sparks produced by said spark-producing means; and means for selectively moving said valve actuation prevention means to any one of said plurality of non-interfering positions, said moving means being movable laterally towards either one of two opposite sides of said housing and subsequently being movable upwards towards one of said non-interfering positions of said receiving means.

2. The flame producing lighter according to claim 1 wherein said valve means is actuated to the open position by actuator means and said means for preventing actuation of said valve means to the open position comprises means for preventing pivotal movement of said actuator means by interference with the movement thereof, said valve actuation interference means being selectively movable to any one of said plurality of positions of said receiving means so as to be out of interference with said valve actuator means.

3. The flame producing lighter according to claim 2 wherein said valve actuation interference means is normally retained in a valve actuation interference position, the movement thereof to any one of said plurality of positions out of interference with said valve actuator means being resiliently provided.

4. The flame producing lighter according to claim 3 wherein the resilient movement of said valve actuation interference means causes said valve actuation interference means to return to its position beneath said valve actuator once the valve actuator is released, thus preventing the valve means from opening.

5. The flame producing lighter according to claim 4 wherein said receiving means comprises a plurality of guide notches, each located in the respective side of said valve actuator, and said valve actuation interference means is a safety latch movable laterally towards either one of two opposite sides of said valve actuator and upwards towards one of said guide notches until said valve actuator is depressed, whereby said gaseous medium exits and the safety latch moves back under the valve actuator when the valve actuator is released.

6. The flame producing lighter according to claim 5 wherein said means for selectively producing sparks comprises flint material and a rotatable spark-producing wheel having a toothed surface positioned and arranged to selectively frictionally contact said flint material.

7. The flame producing lighter according to claim 5 wherein said means for selectively producing sparks comprises electric spark-producing means.

8. The flame producing lighter according to claim 5 wherein said means for selectively producing sparks comprises piezoelectric spark-producing means.

9. A fuel cutoff safety mechanism for use in combination with a lighter comprising:

means for normally preventing actuation of a fuel supply;

a depressable valve actuator which, upon depression, enables fuel to flow out from said fuel supply;

a safety latch normally positioned so as to interfere with depression of said valve actuator and which normally prevents depression of said depressable valve actuator; and means for receiving said safety latch in any one of a plurality of non-interfering positions thereby permitting depression of said valve actuator, wherein application of a biasing force to said safety latch moves said safety latch laterally towards either one of two opposite sides of said valve actuator and subsequently upwards out of said interfering position and into one of said plurality of non-interfering positions so that selective actuation of said fuel supply and a corresponding production of sparks by spark-producing means ignites fuel from said fuel supply.

10. The fuel cutoff safety mechanism according to claim 9 wherein said plurality of positions is two.

11. The fuel cutoff safety mechanism according to claim 10 wherein a portion of said safety latch is normally positioned between said valve actuator and a main body housing of said lighter, thereby preventing depression of said valve actuator.

12. The fuel cutoff safety mechanism according to claim 11 wherein lateral movement of said safety latch in either of two opposite directions provides a void between said valve actuator and said main body housing, said void being sufficient in size to enable said valve actuator to be depressed at least partially into said void.

13. The fuel cutoff safety mechanism according to claim 12 wherein upwards movement at either side of said valve actuator, subsequent to said lateral movement, of said safety latch towards a non-interfering position of said latch receiving means located at least partially adjacent to either side of said valve actuator, said safety latch being resiliently maintained in said non-interfering position by pressure exerted by said safety latch on said valve actuator, enables said lighter to be placed in an unlocked configuration in which said valve actuator is capable of being depressed, thereby permitting fuel to flow.

14. A flame developing lighter comprising:

a housing;

fuel supply means for supplying fuel to be ignited;

ignition means for igniting fuel;

valve means for selectively permitting flow of said fuel;

means for maintaining said lighter in a normally locked configuration in which fuel is prevented from flowing through said valve means; and means for selectively unlocking said lighter from said normally locked configuration, said selectively unlocking means being movable laterally towards either one of two opposite sides of said housing and subsequently being movable upwards towards a top of said lighter into one of a plurality of unlocked positions, and said selectively unlocking means being symmetrical, and operable by a user's same finger as used to actuate the lighter without requiring repositioning of the lighter in the user's hand.

15. The flame developing lighter of claim 14 wherein said means for selectively unlocking said lighter comprises a valve actuator which normally prevents escape of fuel from said fuel supply when in a first position and is depressable to a second position which permits actuation of said fuel supply means thereby permitting fuel to flow out from said fuel supply means, said maintaining means including a safety latch which normally prevents depression of said depressable valve actuator, wherein selective application of a biasing force by the operator to said safety latch permits depression of said valve actuator.

16. The flame developing lighter according to claim 15 wherein a portion of said safety latch is normally positioned between said valve actuator and said housing, thereby preventing depression of said valve actuator.

17. The flame developing lighter according to claim 16 wherein lateral movement in either direction of said safety latch provides a void between said valve actuator and said housing, said void being sufficient in size to enable said valve actuator to be depressed at least partially into said void upon application of said biasing force.

18. The flame developing lighter according to claim 17 wherein upwards movement at either of two sides of said valve actuator, subsequent to said lateral movement, of said safety latch towards an unlocked position of said maintaining means located at least partially adjacent to said valve actuator, said safety latch being resiliently maintained in said unlocked position by pressure exerted by said safety latch on said valve actuator, enables said lighter to be maintained in an unlocked configuration in which said valve actuator is capable of being depressed, thereby permitting fuel to flow.

19. The flame developing lighter according to claim 18 wherein said ignition means comprises a spark-producing wheel and a flint urged against said wheel and wherein sparks are produced by rotation of said wheel.

20. The flame developing lighter according to claim 18 wherein said ignition means comprises electric spark-producing means.

21. The flame developing lighter according to claim 18 wherein said ignition means comprises piezoelectric spark-producing means.

22. An improved flame producing lighter of the type having a housing, a fuel supply, valve means for selectively supplying fuel from said fuel supply to a fuel nozzle and spark-producing means for producing sparks, wherein the improvement comprises means for selectively permitting actuation of said valve means thereby selectively permitting exit of fuel from said fuel supply through said valve means and ignition of said fuel by sparks produced by said spark-producing means, said means for selectively permitting actuation including pivotally mounted actuator means having an unlocked position and a locked position and a safety latch movable laterally to either side of said actuator means and then movable upwards towards either one of two guide notches in said actuator means, said safety latch preventing pivotal movement of said actuator means from said locked position to said unlocked position by interference with the movement thereof, wherein depression of said actuator means in said unlocked position provides fuel flow.

23. A flame developing lighter comprising:

a housing;

fuel supply means for supplying fuel to be ignited;

ignition means for igniting fuel;

valve means for selectively permitting flow of said fuel; and control means for preventing the combination of production of fuel flow and flame generation so as to prevent production of a flame and for permitting substantially simultaneous production of fuel flow and spark generation to produce a flame, said control means being bidirectionally actuatable to any one of a plurality of positions whereby the combination of production of fuel flow and flame generation is permitted, at least a portion of said control means being movable laterally towards either one of two opposite sides of said housing and subsequently being movable upwards towards a top of said housing into one of said positions whereby fuel flow and spark generation is permitted.

24. The flame developing lighter of claim 23 wherein said control means comprises:

a valve actuator which normally prevents escape of said fuel from said fuel supply when in a first position and is depressable to a second position which permits actuation of said fuel supply means thereby permitting fuel to flow out from said fuel supply means; and a safety latch which normally prevents depression of said depressable valve actuator, wherein selective application of a biasing force by the operator to said safety latch permits depression of said valve actuator.

25. The flame developing lighter according to claim 24 wherein a portion of said safety latch is normally positioned between said valve actuator and said housing, thereby normally preventing depression of said valve actuator.

26. The flame developing lighter according to claim 25 wherein lateral movement of said safety latch in either of two directions provides a void between said valve actuator and said housing, said void being sufficient in size to enable said valve actuator to be depressed at least partially into said void.

27. The flame developing lighter according to claim 26 wherein upwards movement along either side of said valve actuator, subsequent to said lateral movement, of said safety latch towards a position at least partially adjacent to said valve actuator, said position being resiliently maintained by pressure exerted by said safety latch on said valve actuator, provides said lighter in one of a plurality of unlocked configurations in which said valve actuator is capable of being depressed, thereby permitting fuel to flow.

28. The flame developing lighter according to claim 27 wherein said ignition means comprises a spark-producing wheel and a flint urged against said wheel and wherein sparks are produced by rotation of said wheel.

29. The flame developing lighter according to claim 27 wherein said ignition means comprises electric spark-producing means.

30. The flame developing lighter according to claim 27 wherein said ignition means comprises piezoelectric spark-producing means.

31. A flame producing lighter resistant to unauthorized use and normally maintained in a locked configuration comprising:

a housing;

fuel supply means for supplying fuel to be ignited;

ignition means for igniting fuel;

valve means for controlling the flow of said fuel;

a valve actuator which normally prevents escape of said fuel when in a first position and is depressable to a second position which permits actuation of said fuel supply means thereby permitting fuel to flow out from said fuel supply means;

a safety latch having an interfering portion which is normally positioned between said valve actuator and said housing, said interfering portion normally preventing depression of said depressable valve actuator and normally maintaining said lighter in said locked configuration;

latch receiving means for receiving said interfering portion of said safety latch in any one of a plurality of non-interfering positions thereby permitting depression of said valve actuator, said latch receiving means being located at least partially adjacent to said valve actuator and on each side thereof, wherein lateral movement of said safety latch in either direction provides a void between said valve actuator and said housing, said void being sufficient in size to enable said valve actuator to be depressed at least partially into said void, and further wherein upwards movement of said safety latch along either side of said valve actuator, subsequent to said lateral movement, into said latch receiving means enables said latch to be resiliently maintained in said latch receiving means by pressure exerted by said valve actuator on said safety latch, so as to provide said lighter in said unlocked configuration in which said valve actuator is capable of being depressed, thereby permitting fuel to flow.

32. The flame producing lighter according to claim 31 wherein said ignition means comprises a spark-producing wheel and a flint urged against said wheel and wherein sparks are produced by rotation of said wheel.

33. The flame producing lighter according to claim 31 wherein said ignition means comprises electric spark-producing means.

34. The flame producing lighter according to claim 31 wherein said ignition means comprises piezoelectric spark-producing means.

35. A flame producing lighter which comprises:

a housing defining reservoir for containing a combustible gaseous medium under pressure;

valve means arranged for selective actuation between a normally closed position which prevents exit of said gaseous medium from said reservoir, and an open position which permits exit of gaseous medium from said reservoir through said valve means;

means for selectively producing sparks at a location proximate the gaseous medium exit opening of said valve means thereby selectively causing ignition of said gaseous medium;

means normally positioned for preventing actuation of said valve means to the open position, said valve actuation prevention means being movable out of said actuation prevention position only by application of an external user applied force, said valve actuation prevention means being retained in said valve actuation prevention position at least until said force is applied thereto; and means for selectively moving said valve actuation prevention means to any one of a plurality of non-interfering positions whereby actuation of said valve means to the open position is permitted thereby selectively permitting exit of said combustible gaseous medium from said valve means and ignition of said gaseous medium by sparks produced by said spark producing means, said moving means being movable laterally towards either one of two opposite sides of said housing and subsequently being movable upwards towards a top of said housing into one of said non-interfering positions.

36. The flame producing lighter of claim 35 further comprising a depressable valve actuator, depression of said valve actuator causing actuation of said valve means, wherein said valve actuation prevention means is normally positioned between said valve actuator and a wall of said housing so as to normally prevent depression of said valve actuator.

37. A flame producing lighter which comprises:

a housing defining reservoir for containing a combustible gaseous medium under pressure;

valve means arranged for selective actuation between a normally closed position which prevents exit of said gaseous medium from said reservoir, and an open position which permits exit of said gaseous medium from said reservoir through said valve means;

means for selectively producing sparks at a location proximate the gaseous medium exit opening of said valve means thereby selectively causing ignition of said gaseous medium; and valve actuation prevention means movable laterally towards either one of two opposite sides of said housing and subsequently movable upwards towards a top of said housing from a first default position whereby actuation of said valve means to the open position is prevented, to one of a plurality of other positions whereby actuation of said valve means is permitted, said valve actuation prevention means being movable from said default position to any of said other positions only by application of an external user applied force.

38. The flame producing lighter of claim 37 further comprising a depressable valve actuator, depression of said valve actuator causing actuation of said valve means, wherein said valve actuation prevention means is normally positioned between said valve actuator and a wall of said housing so as to normally prevent depression of said valve actuator.

39. A flame producing lighter which comprises:

a housing defining reservoir for containing a combustible gaseous medium under pressure;

valve means for controlling flow of said gaseous medium;

means pivotally mounted for selective actuation of said valve means between a normally closed position which prevents exit of said gaseous medium from said reservoir, and an open position which permits exit of gaseous medium from said reservoir through said valve means;

means for selectively producing sparks at a location proximate the gaseous medium exit opening of said valve means thereby selectively causing ignition of said gaseous medium; and means positioned between said valve actuation means and at least a portion of said housing and configured, dimensioned and adapted to interfere with depression of said valve actuation means for preventing actuation of said valve means to the open position, said valve actuation prevention means being movable laterally towards either of two opposite sides of said valve actuation means and subsequently movable upwards towards a top of said housing to one of a plurality of positions out of interference with said valve actuation means only by application of an external user applied force and returnable automatically to said valve actuation prevention position after said valve means is moved to the open position and said valve actuation means released.

40. The flame producing lighter of claim 39 wherein said interference means is a safety latch comprising:

a movable finger actuated portion adapted to be moved so as to place said lighter in an unlocked configuration;

an interfering portion connected to said finger actuated portion for interfering with depression of said actuation means;

a central portion having an opening therein adapted for placement around a spring and serving to retain said safety latch in proximity with said actuation means; and a pair of extension legs for facilitating deflection and stabilization of said safety latch within said lighter.

41. The flame producing lighter of claim 39 wherein said plurality of positions is two, one on each side of said valve actuation means and at least partially defined by a notch in each side of said valve actuation means.

42. A flame producing lighter which comprises:

a housing defining reservoir for containing a combustible gaseous medium under pressure;

valve means for controlling flow of said gaseous medium;

means pivotally mounted for selective actuation of said valve means between a normally closed position which prevents exit of said gaseous medium from said reservoir, and an open position which permits exit of gaseous medium from said reservoir through said valve means;

means for selectively producing sparks at a location proximate the gaseous medium exit opening of said valve means thereby selectively causing ignition of said gaseous medium;

means for receiving said valve actuation means so as to facilitate fuel flow through the valve means and ignition thereof, said receiving means having a plurality of positions which do not interfere with said valve actuation means; and means positioned beneath at least a portion of said valve actuation means so as to interfere with the pivotal movement of said valve actuation means for preventing actuation of said valve means to the open position, said valve actuation prevention means being movable laterally towards either of two opposite sides of said valve actuation means and subsequently movable upwards towards a top of said housing out of interference with said valve actuation means to one of said plurality of non-interfering positions only by application of an external user applied force, said valve actuation prevention means being retained in said valve actuation prevention position until said force has been applied to said valve actuation prevention means so as to move said valve actuation prevention means to one of said plurality of non-interfering positions.

43. The flame producing lighter of claim 42 wherein said interference means is a safety latch comprising:

a movable finger actuated portion adapted to be moved so as to place said lighter in an unlocked configuration;

an interfering portion connected to said finger actuated portion for interfering with depression of said actuation means;

a central portion having an opening therein adapted for placement around a spring and serving to retain said safety latch in proximity with said actuation means; and a pair of extension legs for facilitating deflection and stabilization of said safety latch within said lighter.

44. A flame developing lighter comprising:

a housing;

fuel supply means for supplying fuel to be ignited;

ignition means for igniting said fuel;

valve means for selectively permitting flow of said fuel proximate the ignition provided by said ignition means;

a valve actuator which normally prevents escape of said fuel from said fuel supply means when in a first position and is depressable to a second position which permits actuation of said fuel supply means thereby permitting fuel to flow out from said fuel supply means; and a safety latch which normally prevents depression of said depressable valve actuator, at least a portion of said safety latch being normally positioned between said valve actuator and said housing, thereby preventing depression of said valve actuator, wherein selective application of a force by the operator to said safety latch moves said safety latch laterally towards either of two opposite sides of said valve actuator and subsequently upwards towards a top of said housing out of said position between said valve actuator and said housing and into one of a plurality of non-interfering positions substantially adjacent said valve actuator in which said latch may be releasably locked to permit depression of said valve actuator.

45. The flame developing lighter of claim 44 wherein said safety latch comprises:

a movable finger actuated portion adapted to be moved so as to place said lighter in an unlocked configuration;

an interfering portion connected to said finger actuated portion for interfering with depression of said valve actuator;

a central portion having an opening therein adapted for placement around a spring and serving to retain said safety latch in proximity with said valve actuator; and a pair of extension legs for facilitating deflection and stabilization of said safety latch within said lighter.

46. The flame developing lighter according to claim 45 wherein lateral movement of said safety latch in either of two directions provides a void between said valve actuator and said housing, said void being sufficient in size to enable said valve actuator to be depressed at least partially into said void.

47. A flame producing lighter which comprises:

a housing defining reservoir for containing a combustible gaseous medium under pressure;

valve means for controlling flow of said gaseous medium;

actuator means pivotally arranged for selective actuation of said valve means between a normally closed position which prevents exit of said gaseous medium from said reservoir, and an open position which permits exit of gaseous medium from said reservoir through said valve means;

means for preventing pivotal movement of said actuator means by interference with the movement thereof, said valve actuation interference means being selectively movable laterally towards either of two opposite sides of said actuator means and subsequently movable upwards towards a top of said housing to one of two positions out of interference with said valve actuator means, said valve actuation interference means being normally retained in a valve actuation interference position, the movement thereof to either one of said positions out of interference with said valve actuator means being resiliently provided so as to return said valve actuation interference means to its position in interference with said valve actuator when said valve actuator is released, thus preventing said valve means from opening: and means for selectively producing sparks at a location proximate the gaseous medium exit opening of said valve means thereby selectively causing ignition of said gaseous medium.

48. The flame producing lighter of claim 47 wherein said valve actuation interference means is a safety latch comprising:

a movable finger actuated portion adapted to be moved so as to place said lighter in an unlocked configuration;

an interfering portion connected to said finger actuated portion for interfering with depression of said actuator means;

a central portion having an opening therein adapted for placement around a spring and serving to retain said safety latch in proximity with said actuator means; and a pair of extension legs for facilitating deflection and stabilization of said safety latch within said lighter.

49. A fuel cut-off safety mechanism for use in combination with a lighter which comprises:

means for normally preventing actuation of a fuel supply;

means for selectively permitting actuation of said fuel supply including a depressible valve actuator which upon depression actuates said fuel supply thereby permitting fuel to flow out from said fuel supply; and a safety latch which normally prevents depression of said depressible valve actuator, said safety latch being normally positioned between said valve actuator and a main body housing of said lighter so as to prevent depression of said valve actuator, said safety latch being arranged such that lateral movement of said safety latch in either direction provides a void between said valve actuator and said main body housing, the void being sufficient in size to enable said valve actuator to be depressed at least partially thereinto; and a notch on each side of said valve actuator for receiving said safety latch, wherein upward movement of said safety latch on either side of said valve actuator, subsequent to said lateral movement, into one of said notches causes said safety latch to be resiliently maintained therein by force exerted by said safety latch on said valve actuator, thereby placing said lighter in an unlocked configuration wherein said valve actuator is capable of being depressed thereby permitting fuel to flow, said safety latch including:

a movable finger actuated portion adapted to be moved so as to place said lighter in an unlocked configuration;

an interfering portion connected to said finger actuated portion for interfering with depression of said actuation means;

a central portion having an opening therein adapted for placement around a spring and serving to retain said safety latch in proximity with said actuation means; and a pair of extension legs for facilitating deflection and stabilization of said safety latch within said lighter.

* * * * *

UNITED STATES PATENT AND TRADEMARK OFFICE
CERTIFICATE OF CORRECTION

PATENT NO. : 5,125,829

DATED : June 30, 1992

INVENTOR(S) : James M. McDonough, Floyd B. Fairbanks, Thomas G. Snell

It is certified that an error appears in the above-identified patent and that said Letters Patent is hereby corrected as shown below:

On the title page, item (75) Inventors:

Should read -- James M. McDonough, Guilford; Floyd B. Fairbanks, Naugatuck; Thomas G. Snell, Madison, all of Connecticut --.

Signed and Sealed this

Twenty-first Day of December, 1993

*Attest:*

Bruce Lehman

BRUCE LEHMAN

*Attesting Officer*

*Commissioner of Patents and Trademarks*